US005323631A

United States Patent [19]

Weykamp et al.

[11] Patent Number: 5,323,631

[45] Date of Patent: Jun. 28, 1994

[54] METHOD FOR FORMING A HOLLOW WORKPIECE USING A SNAKE TOOL

[75] Inventors: Robert E. Weykamp, Plum Boro; Robert P. Evert, Allison Park, both of Pa.

[73] Assignee: Aluminum Company of America, Pittsburgh, Pa.

[21] Appl. No.: 48,806

[22] Filed: Apr. 16, 1993

[51] Int. Cl.[5] ..... B21D 11/02; B21D 9/03

[52] U.S. Cl. ..... 72/296; 72/466

[58] Field of Search ..... 72/296, 297, 466, 465, 72/370, 150

[56] References Cited

U.S. PATENT DOCUMENTS

| | | | |
|---|---|---|---|
| 1,654,697 | 1/1928 | Mueller | 72/466 |
| 1,748,158 | 2/1930 | Walp | 72/466 |
| 2,267,774 | 12/1941 | Wall | 72/466 |
| 2,729,265 | 1/1956 | Jones | 72/466 |
| 2,889,864 | 6/1959 | Bowser | 72/465 |
| 4,608,849 | 9/1986 | Brugman | 72/466 |
| 4,671,096 | 6/1987 | Crosby | 72/466 |
| 4,744,233 | 5/1988 | Trudell | 72/466 |
| 5,131,254 | 7/1992 | White | 72/466 |

FOREIGN PATENT DOCUMENTS

| | | | |
|---|---|---|---|
| 158189 | 10/1963 | U.S.S.R. | 72/466 |
| 301205 | 4/1971 | U.S.S.R. | 72/466 |
| 963609 | 2/1983 | U.S.S.R. | 72/466 |
| 1397121 | 5/1988 | U.S.S.R. | 72/466 |

*Primary Examiner*—Daniel C. Crane
*Attorney, Agent, or Firm*—Elroy Strickland

[57] ABSTRACT

A tool device for supporting one or more walls of an elongated hollow member located in a recess of a die for bending said member over a surface of the die while said member is in a stretched condition. The tool device comprises a plurality of segments held together in a snake-like arrangement by at least one cable extending through the segments. Opposed ends of the cable are provided with means for connecting the cable to opposed clamp assemblies of stretch bend apparatus.

1 Claim, 2 Drawing Sheets

METHOD FOR FORMING A HOLLOW WORKPIECE USING A SNAKE TOOL

BACKGROUND OF THE INVENTION

The present invention relates generally to stretch bend apparatus for forming hollow workpieces and particularly to a snake tool device for supporting a wall or walls of a hollow extrusion having a non-symmetrical shape in cross section while the extrusion undergoes stretching, bending, and twisting.

Elongated hollow members can take many shapes in cross section. This is particularly true for hollow aluminum extrusions employed in constructing spaceframes for motor vehicle, for example, as shown in U.S. Pat. No. 4,618,163 to Hasler et al. Such extrusions are bent and stretched to provide lineals having appropriate shapes for forming a vehicle frame, as a frame cannot generally be constructed with straight pieces only. The underlying principle of stretch forming involves applying tension to a generally straight workpiece such that it yields plastically, and deformation is imposed by bending or wrapping the workpiece around the curved surface of a die that results in proper modes of plastic flow so that the workpiece retains the desired linear configuration after stretching and bending, and after being subjected to certain twisting, depending upon the use of the formed workpiece. Stretch bend apparatus includes two, opposed clamping assemblies that grip the ends of an elongated workpiece to bend the same around the curved surface of a die while clamping assemblies apply tension to the workpiece. The surface of the rounded die is generally configured to that of the cross sectional shape of the workpiece so that the workpiece is properly supported while it is being formed. If the workpiece is hollow, the walls of the workpiece can be supported against collapse by a pressurized fluid supplied to the interior of the workpiece. Though the walls of a hollow, non-symmetric extrusion can be supported internally by a pressurized medium, certain wall portions of such a hollow extrusion will tend to bulge outwardly in the proces of the extrusion being formed over the curved die surface. The walls or wall portions of the hollow extrusion seated in and against the die surfaces are, of course, supported by the die surfaces.

SUMMARY OF THE INVENTION

It is therefore an object of the present invention to provide external tooling for supporting walls of a hollow workpiece that are not supported by the die surfaces such that the cross sectional shape of the workpiece is maintained during stretching and bending.

Another objective of the invention is to provide support tooling for surfaces of the workpiece which lie along the primary bend planes (about which the extrusion is formed) for a workpiece formed in three dimensions within a die, and easy removal of the workpiece from the die after the support tooling is removed from the die.

More particularly, these objectives are effected by an elongated snake-like tool in the form of tool segments bound together by cable means that is connected to the clamping assemblies of stretch bend apparatus before the workpiece is stretched and bent. When the clamping assemblies move to wrap the hollow workpiece about the curved die surface, the ends of the elongated snake-like tool move with the clamping assemblies and force the tool segments against the wall or walls of the hollow workpiece that are not supported by the curve die surfaces. The surface or surfaces of the tool segments that bear against the walls of the workpiece have the same configuration of the wall surfaces so that in the bending and wrapping process the configuration of the walls is maintained.

Another objective of the invention is to provide a snake-like tool means having a certain rigidity so that it is easily handled by workmen. It can be appreciated that in connecting the snake tool to and removing the same from clamping assemblies and from the workpiece that has been stretched and bent the snake tool cannot be "loose" to the extent it "flops around" and therefore is difficult to handle.

BRIEF DESCRIPTION OF THE DRAWINGS

The advantages and objectives of the present invention will be better understood from consideration of the following detailed description and the accompanying drawings in which.

DETAILED DESCRIPTION OF A PREFERRED EMBODIMENT

Figure 1:
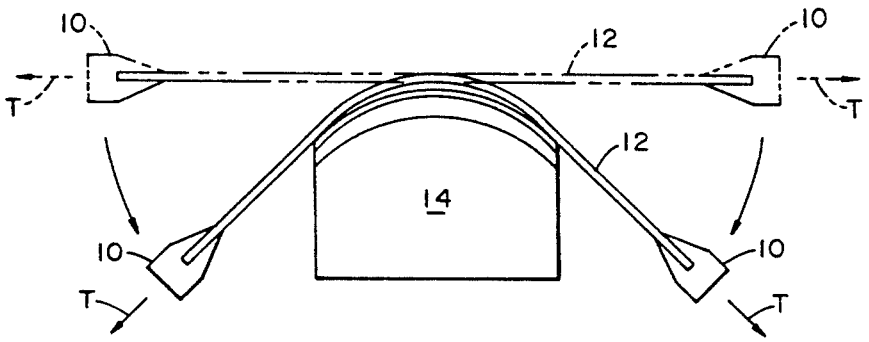
FIG. 1 (PRIOR ART)
FIG. 1 is a generally schematic view of a conventional stretch-wrap or bend forming process and apparatus employing a forming die and clamp assemblies.

Referring now to FIG. 1 of the drawings, a fragmentary portion of a conventional stretch forming apparatus is shown in which a pair of opposed clamp assemblies 10 grip an elongated workpiece 12 to bend the same around the curved surface of a die 14. The clamp assemblies, in addition, apply a tension T to the workpiece using known tensioning means such as hydraulic piston cylinders (not shown) connected to the clamping assemblies. The amount of tension applied exceeds the elastic limit of the workpiece material. Such apparatus is shown in U.S. Pat. Nos. 2,464,169, 4,704,886, 4,803,878, 4,815,308, and 4,827,753 to Bentley, Evert et al, and Moroney, respectively.

Figure 2:
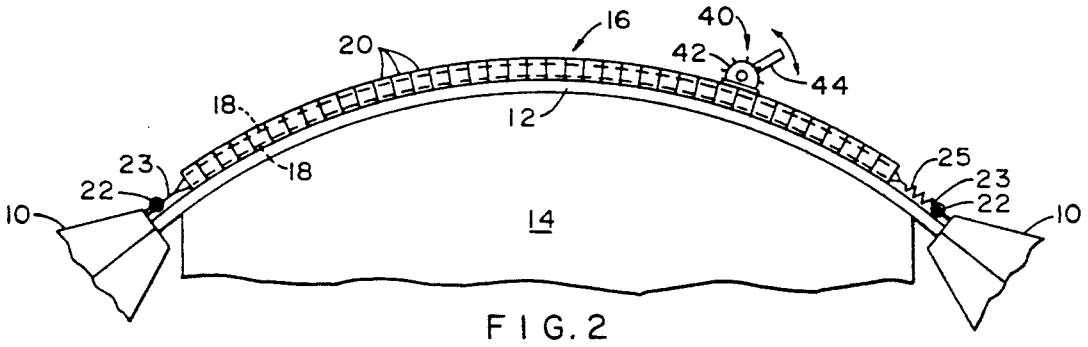
FIG. 2 is a diagrammatic view of a forming die and a snake tool for supporting a wall or walls of an elongated hollow member while it is being bent and stretched.

FIG. 2 of the drawings shows the snake tool of the invention, generally designated by numeral 16, seated in the recess of a forming die (14) and against a hollow workpiece (12). The tool is comprised of separate segments 20 that are connected together by a cable 18 that extends through segments 20.

In FIG. 2, each clamp assembly is shown provided with a hook eye 22 which, as shown in co-pending application Ser. No. 48,831 filed Apr. 16, 1993 by Inventors Robert E. Weykamp, Robert P. Evert and Robert J. Martin entitled "Production Mandrel and Jaws for Stretch Forming", is threaded into an upper jaw member of the clamp assembly. The hookeye receives an open hook 23 provided at each end of cable 18. A workman, in connecting snake tool 16 to clamp assemblies 10, need only insert cable hooks 23 through hook eyes 22 before the workpiece 12 is stretched and bent, and simply unhook the hooks from the hook eyes after the workpiece is stretched and bent when tension on the snake tool is released after the stretching and bending. Other means, of course, can be employed to connect and disconnect the snake tool to and from the clamp assemblies.

Cables 18 can be provided with an appropriate tensioning or biasing capability that provides the cable with a certain stress relief while simultaneously forcing segments 20 against workpiece 12 when it is stretched and bent over die 14. This can be effected by designing into the cable an inherent biasing capability when strands of the cable are woven together. Or, a spring 25 (FIG. 2) can be connected between the cable end (or ends) and clamping assemblies 10. Similarly, a hydraulic cylinder may be used to assist in pulling the snake against a workpiece.

Figure 3:
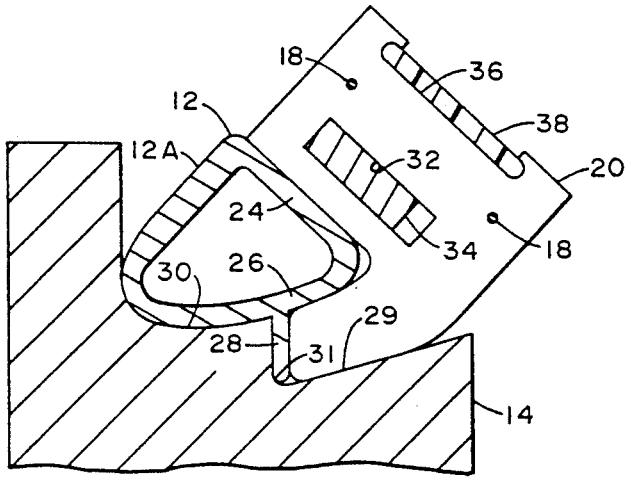
FIG. 3 is a partial sectional view of a forming die and elevation view of one segment of the snake tool of FIG. 2 shown supporting the walls of a hollow extrusion not supported in the die surfaces.

FIG. 3 of the drawings shows in section a forming die 14 and a non-symmetric (in cross section) hollow workpiece 12 (using the numerals of FIGS. 1 and 2) and one segment 20 of the snake tool 16 depicted in FIG. 2. The cross sectional shape of segments 20 is such that they provide surfaces that conform to the exterior wall 24 and interior wall 26 of the workpiece, and to a solid protrusion 28, and to the surface 29 of the die. Interior wall portions 26 and 28 also rest on curved die surfaces 30 and 31. In this manner, the snake tool abuts against those portions (24, 26, and 28) of workpiece 12 and die surface 29 to prevent bulging of walls 24 and 26 when the workpiece interior is supplied with a fluid under pressure, such as plant air, and is stretched and bent over die 14, as discussed in detail hereinafter. An outer wall 12A in FIG. 3 is not affected by bending, as its thickness is sufficient to withstand the amount of the pressure of air or other medium that may be supplied to the interior of a workpiece 12. In other cases, an exposed wall will need to be supported.

The cross sectional shape of the tool segment 20 in FIG. 3 is such that two, relatively small diameter cables 18 are used to connect the segments of the snake tool together. The material of the cables is preferably that of stranded or braided steel. Such cables extend through aligned openings in the segments, the openings being essentially filled by the cables, though the segments are relatively loose on the cables so that they can easily slide on a strap 38 that is discussed below.

In addition to the openings in the tool segments 20 that contain cables 18, an additional opening 32 is shown provided in the segments to house a stiffening rod 34. The opening 32 and rod 34 have a rectangular shape in cross section that permits greater stiffness in the direction of the large dimension of the rectangle and less stiffness in the small dimension of the rectangle. As seen in FIG. 3, greater stiffness of the large dimension of 34 supports exterior wall 24 and interior portions 26 and 28 of the workpiece while the lesser stiffness of 34 permits bending of the snake tool 16 around the curved surface of die 14. In either case, when workmen handle the snake tool, stiffeners 34 provide a certain "integrity" to the tool such that it can be expeditiously handled.

In addition to the openings provided in tool segments 20 to contain cables 18 and stiffener 34, a third set of openings or slots 36 is provided in the segments near the outer edges of the segments to receive and accommodate a flexible strap 38. Strap 38 and a means 40 suitably connected to the strap provide tightening and loosening of the tool segments, and clamping of strap in a tight condition. More particularly, means 40 is depicted in FIG. 2 as a clamp and ratchet device that engages strap 38 in a manner that translates the strap so that slack is removed from the strap and slack is returned to the strap. With slack removed and with the cables 18 connected to the clamp assemblies 10 (FIG. 2), tool segments 20 are brought together and against wall portions 24, 26, and 28 of the workpiece. When slack is restored to strap 38, the segments are loosened on cables 18, and on the strap, so that the cable ends can be removed from clamp assemblies 10.

Ratchet means 40, as shown in FIG. 2, wraps and unwraps strap 38 about a ratchet wheel 42 that is rotated by manual action of a handle 44. The depiction of ratchet 40 in FIG. 2 is somewhat schematic. Any means capable of drawing strap 38 together in a manner that tightens it in segments 20, and thus against workpiece 12, and releases tension after bending but prior to removal of the snake tool, can be used for the purposes of the invention.

Figure 4:
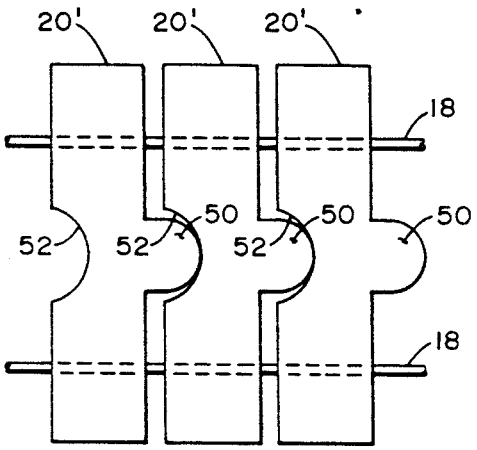
FIG. 4 is an elevation view of two tool segments provided with integral spacers that separate the segments.
Figure 5:
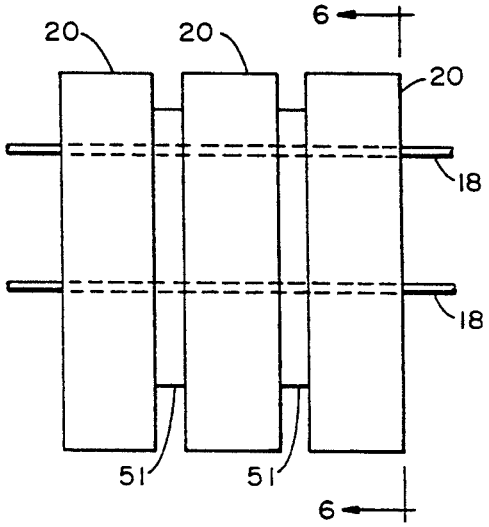
FIG. 5 is an elevation view of two tool segments and a spacer that is separate from the tool segments.
Figure 6:
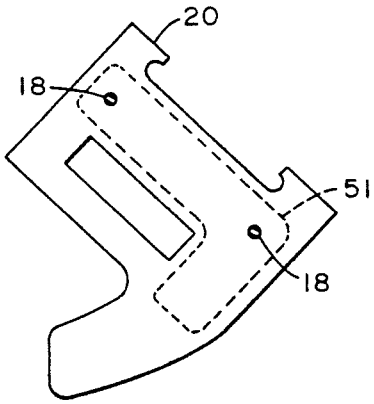
FIG. 6 is an end view taken on lines 6—6 of one of the segments of FIG. 5, with the spacer in dash outline.

The tool segments 20 are preferably separated by spacers 50 or 51, as shown in FIGS. 4 to 6. Such spacers increase the ability of the segments to rotate relative to one another, as the segments follow the curve of the forming die 14 in the processes of bending and stretching workpiece 12. The spacers have a smaller breadth dimension than that of the segments, which permits such relative movement or rotation of the segments. Further, the spacers 51 can be devices separate from the segments, as shown in FIGS. 5 and 6, and held in place by cables 18 extending through them. In FIG. 4, each spacer 50 is an integral extension of 20', the end of which is rounded. The rounded end seats in a bowl-shaped depression or socket 52 provided in the next adjacent segment. In this manner, each segment can rotate in the next adjacent socket 52.

The use of the snake tool of the invention is as follows. The ends of the workpiece 12 are secured in clamp assemblies 10, the workpiece being in a generally unbent, straight condition. The snake tool 16 is now grasped by a workman and connected to the clamp assemblies by simply inserting hooks 23 through the hook eyes 22 of the clamp assemblies. This requires that the snake tool be slack, i.e., that ratchet clamp 40 be in a position to provide slack in strap 38. At this time, in most cases, prior to removing slack from strap 38, the snake rests on the extrusion by virtue of the force of gravity. In cases where the force of gravity cannot be used, the snake will need to be supported in a manner that will keep it from falling off the extrusion or sagging prior to being seated on the extrusion before commencing the forming operation. In addition, the loading and unloading of the snake tool can be automated by support linkage attached to both the tool and the die or clamping assemblies. Such "automatic" handling of the snake tool minimizes the need for operator handling.

The connection of the snake tool to the clamp assemblies locates the segments 20 of the tool against the wall or walls of the workpiece facing in the direction of the tool. In the case of the workpiece and segment shown in FIG. 3, the segment rests against exterior wall 24, interior wall 26, and extension 28 of the workpiece. Since the tool segments have surfaces configured to the surfaces of the workpiece, the workman must properly orient the segments to the workpiece before the workpiece is stretched and bent.

With the ends of workpiece 12 clamped in assemblies 10 and the snake tool 16 connected to the assemblies 10, the workman rotates handle 44 to tighten segments 20 together by removing slack from strap 38, and then clamps the strap in the tightened condition. This secures the segments in place against the walls of the workpiece for stretching and bending by the apparatus of FIG. 1. The configured surfaces of the segments prevents the walls 24 and 26 (in FIG. 3) of the workpiece from outwardly bulging and/or wrinkling during stretching and bending if the interior of the workpiece is pressurized with a fluid medium. Die surface 30 supports a portion of wall 26 while die surface 31 supports a portion of wall extension 28. The lowermost portion of each segment also supports extension 28 opposite die surface 31.

After stretching and bending and after any twisting of the workpiece that may have taken place, clamp assemblies 10 are automatically operated to release the ends of the workpiece. The workman now rotates clamp arm 44 to unclamp and release the snake tool so that it can be removed from the clamp assemblies and from die 14. When segments 20 are removed from the die, a space is left in the die adjacent extension 28, see FIG. 3. This space allows easy removal of the workpiece after forming the workpiece. If extension 28 was wholly supported and thus enclosed by the die, any twisting of the workpiece involved in forming the workpiece would tend to "lock" the extension in the die such that it would be difficult for a workman to remove the workpiece from the die. The empty space next to 28 after the segments are removed obviates this problem. The snake tool is laid aside and the workpiece is sent on to further operations and processes, depending upon its end use.

The above steps involved in the use of the snake tool are then repeated when the next workpiece is ready for forming.

Stiffener 34, as discussed earlier, makes the snake tool easy to handle, as they provide a certain stiffness to the tool yet, because of its dimensional orientation within the segments of the tool, allow the segments to conform to the workpiece as it is being bent, stretched, and/or twisted. The tool can also be made light in weight if the segments are made from a durable light weight material such as Delrin, a trademark of E. I. DuPont de Nemours and Company.

While the invention has been described in terms of preferred embodiments, the claims appended hereto are intended to encompass all embodiments which fall within the spirit of the invention.

What is claimed is:

1. A method of forming an elongated hollow workpiece capable of supporting internally a fluid under pressure over a curved surface of a die member, the method comprising:

locating the workpiece adjacent the die member;

gripping the ends of the workpiece on opposite sides of the die member with jaw devices;

locating a flexible tool device comprised of movable tool segments held together by cable means against at least one exterior wall of the elongated hollow workpiece for maintaining the cross-sectional dimension of the workpiece during forming, said tool segments each having an extension that seats in a space between and against both the hollow workpiece and a forming surface of the die member;

connecting the ends of the cable means to the jaw devices;

tensioning the cable means such that the tool segments are tightened against the hollow workpiece; and forming the hollow workpiece by stretching and bending it over the curved surface of the die member while supporting the one exterior wall of the hollow workpiece with the tool segments and seating the extensions in the space between the workpiece and die member, and in a manner that permits ease of removal of the workpiece from the die member after stretching and bending and after the flexible tool device is removed from the workpiece and the extensions of the segments are removed from the space between the workpiece and die member.

* * * * *